US007452231B2

(12) United States Patent
Wan

(10) Patent No.: US 7,452,231 B2
(45) Date of Patent: Nov. 18, 2008

(54) PORTABLE ELECTRONIC DEVICE

(75) Inventor: Jun Wan, Jiangsu (CN)

(73) Assignee: Qisda Corporation, Taoyuan County (TW)

( * ) Notice: Subject to any disclaimer, the term of this patent is extended or adjusted under 35 U.S.C. 154(b) by 0 days.

(21) Appl. No.: 11/749,019

(22) Filed: May 15, 2007

(65) Prior Publication Data

US 2008/0113546 A1 May 15, 2008

(30) Foreign Application Priority Data

Nov. 14, 2006 (TW) ..... 95142050 A

(51) Int. Cl.
*H01R 13/267* (2006.01)

(52) U.S. Cl. ..... 439/350

(58) Field of Classification Search ..... 439/350, 439/131, 135–137, 638, 260, 76.1, 79; 235/441; 382/124; 361/685, 737; 343/303
See application file for complete search history.

(56) References Cited

U.S. PATENT DOCUMENTS 7,025,275 B2 * 4/2006 Huang et al. ..... 235/486
7,179,099 B2 * 2/2007 Hsieh ..... 439/131

* cited by examiner

*Primary Examiner*—Alexander Gilman

(57) ABSTRACT

A portable electronic device is disclosed. The portable electronic device includes a body, a circuit board, and a USB plug. The body includes a top cover and a bottom cover. The top cover is engaged with the bottom cover. The circuit board is disposed in the body. The USB plug includes a metallic plug and an insulating portion connecting with the metallic plug. The USB plug is detachably disposed between the top cover and the bottom cover and transits between a first position and a second position. When the USB plug is in the first position, the metallic plug and the insulating portion abut against the top cover and the bottom cover. When the USB plug is in the second position, the metallic plug is disposed outside the body.

15 Claims, 11 Drawing Sheets

PORTABLE ELECTRONIC DEVICE

BACKGROUND OF THE INVENTION

1. Field of the Invention

The invention relates to a portable electronic device, and more particularly to a portable electronic device with a detachable USB (Universal Serial Bus) plug.

2. Description of the Related Art

Conventional electronic devices, such as the mobile phone 1 of FIG. 1, frequently comprise a connecting groove 11. Data communication with a computer 2 requires the use of an additional transmit cable 3. The transmit cable 3 comprises a plug 3*a* with a plurality of pins and a USB plug 3*b*, wherein the plug 3*a* and the USB plug 3*b* at one end of the transmit cable 3. The USB plug is inserted into the USB socket 2*a* of computer 2.

Thus, data communication between mobile phone 1 and computer 2 is inconvenient due to the need for the transmit cable 3.

BRIEF SUMMARY OF THE INVENTION

Portable electronic devices with a detachable USB plug are provided. An exemplary embodiment of a portable electronic device comprises a body, a circuit board, and a data communication plug. The body comprises a top cover and a bottom cover. The top cover is engaged with the bottom cover. The circuit board is disposed in the body. The data communication plug comprises a metallic plug and an insulating portion. The data communication plug is detachably disposed between the top cover and the bottom cover and transit between a first position and a second position. When the data communication plug is in the first position, the metallic plug and the insulating portion abut against the top cover and the bottom cover. When the data communication plug is in the second position, the metallic plug is disposed outside the body.

The top cover comprises a first indentation and a first concavity, wherein the first indentation is vertical and adjacent to the first concavity. The bottom cover comprises a second indentation and a second concavity. The second indentation is vertical and adjacent to the second concavity. The first concavity corresponds to the second concavity. The first concavity comprises a first hook and the second concavity comprises a second hook, the first hook is opposite the corresponding position of the second hook.

The insulating portion comprises a third hook, a fourth hook, and a protrusion. The fourth hook is disposed opposite the corresponding position of the third hook. the protrusion is disposed between the third hook and the fourth hook, wherein when the data communication plug is in the first position, the first hook is engaged with the third hook and the second hook is engaged with the fourth hook, the protrusion is engaged with the first indentation and the second indentation, and the metallic plug is received in the body.

The top cover further comprises a top sliding portion and the bottom cover further comprises a bottom sliding portion, the top sliding portion is disposed in the first indentation and the bottom sliding portion is disposed in the second indentation.

The top sliding portion and the bottom sliding portion comprise a plurality of correspondingly disposed sliders. The top cover further comprises a first limiting portion and the bottom cover comprises a second limiting portion. The first limiting portion corresponds to the second limiting portion. The first limiting portion and the second limiting portion are respectively connected to the top and bottom sliding portions.

The first and second limiting portions further comprise a plurality of correspondingly disposed limiting elements.

The insulating portion further comprises a first connector and the circuit board further comprises a second connector, when the data communication plug is in the second position, the first connector is connected to the second connector. The second connector is an elastic structure.

A detailed description is given in the following embodiments with reference to the accompanying drawings:

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
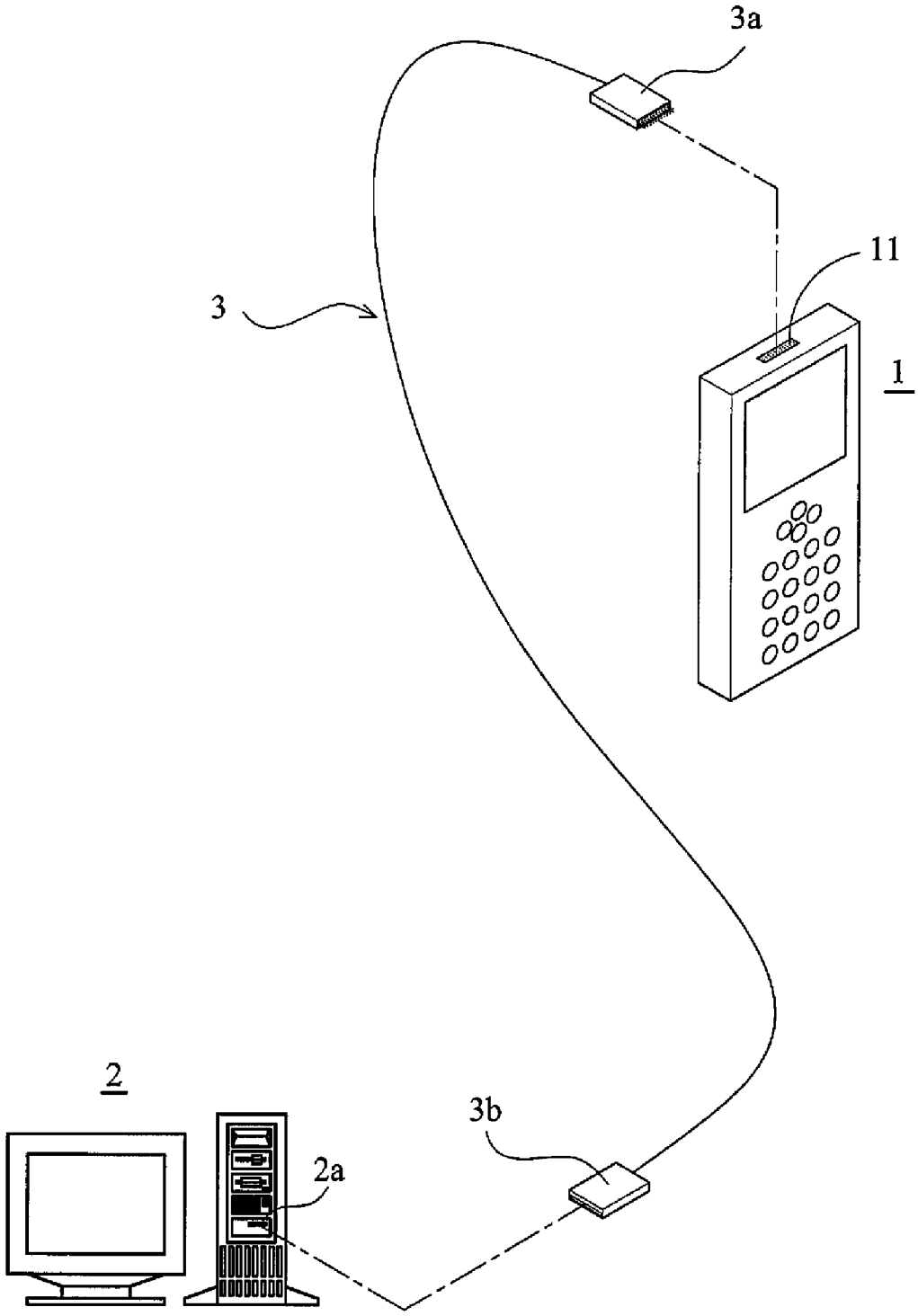
FIG. 1 ( PRIOR ART )
FIG. 1 is a schematic view of a conventional portable electronic device.
Figure 2:
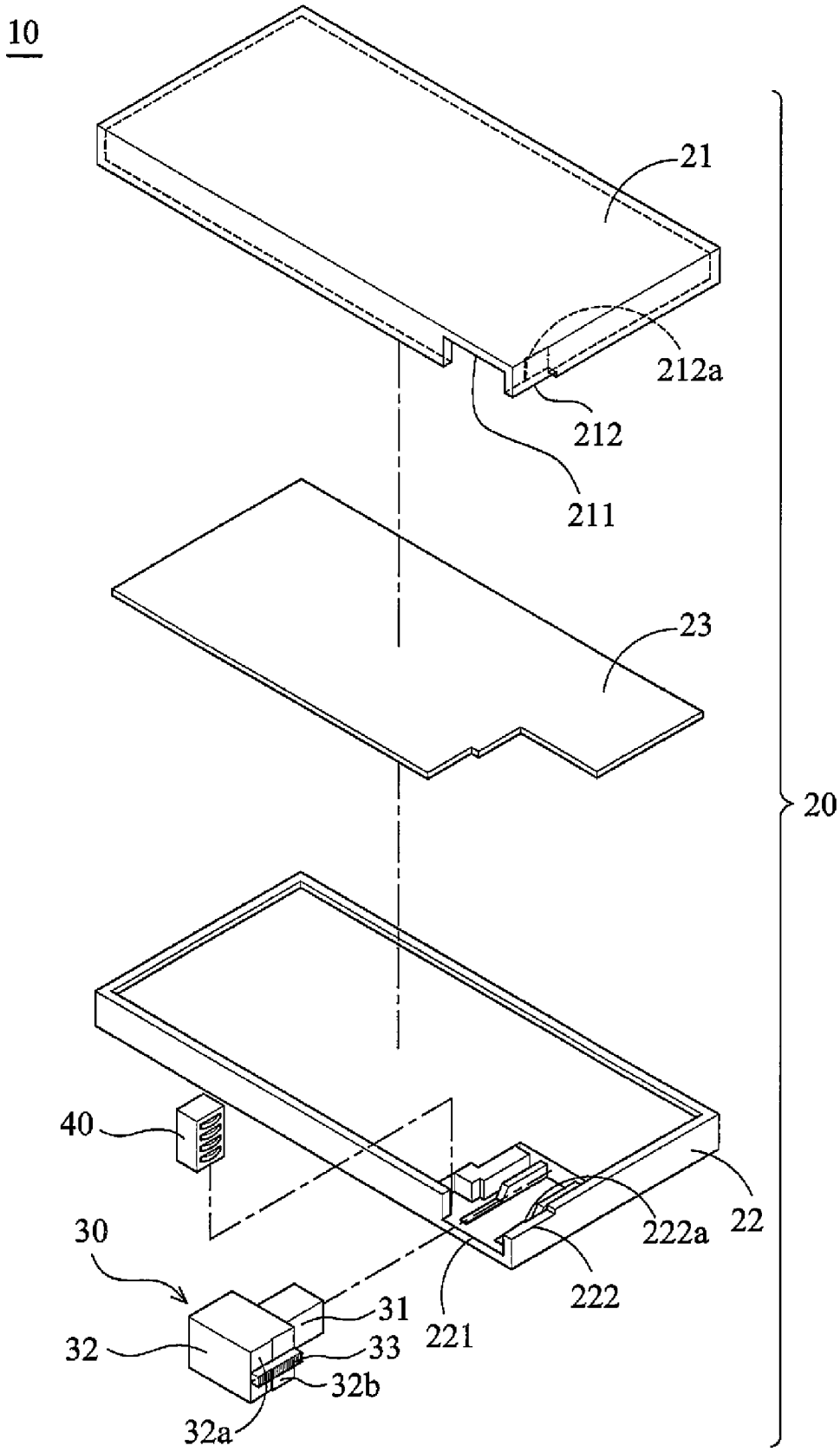
FIG. 2 is an exploded schematic view of an embodiment of a portable electronic device.
Figure 8:
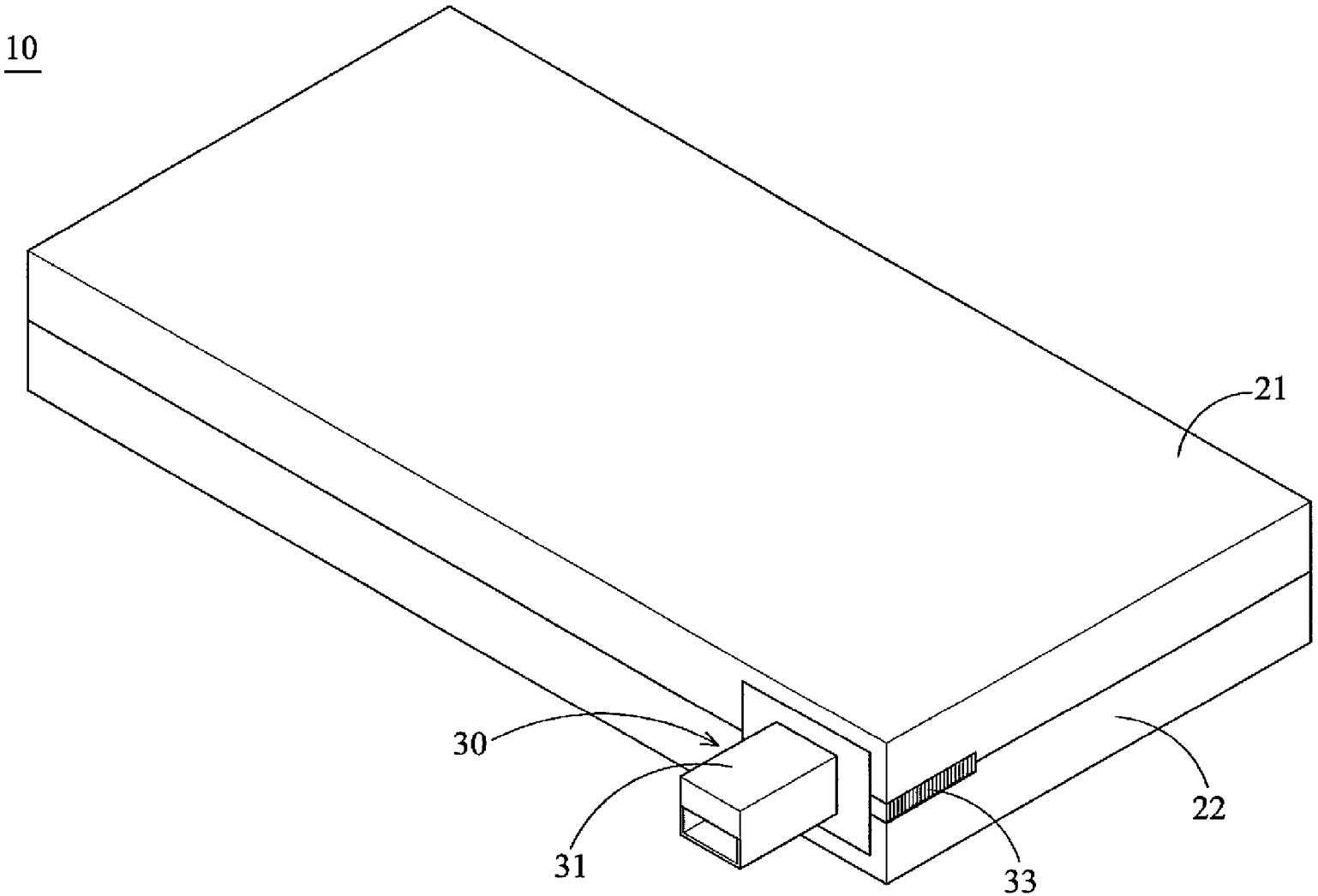
FIG. 8 is a schematic view of the USB plug of an embodiment of the portable electronic device in a second position.
Figure 9:
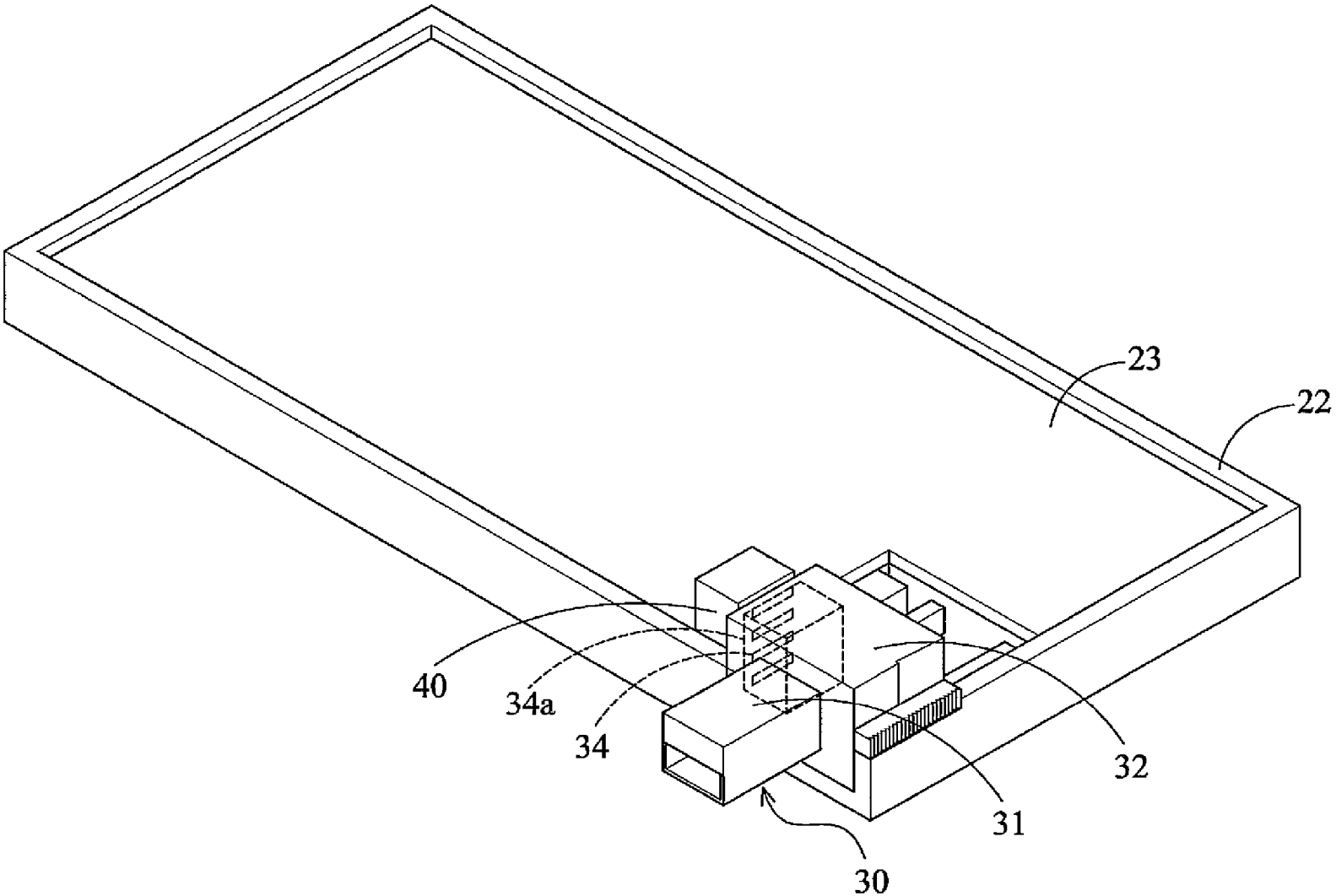
FIG. 9 is a schematic view of FIG. 8, wherein the top cover is removed.

Referring to FIG. 2, a portable electronic device 10 comprises a body 20, a circuit board 23, and a USB plug 30. The body 20 comprises a top cover 21 and a bottom cover 22. The USB plug 30 comprises a metallic plug 31 and an insulating portion 32. The insulating portion 32 is connected to the metallic plug 31. The USB plug 30 is detachably disposed between the top cover 21 and a bottom cover 22 for transiting between a first position (as shown n FIG. 3 and FIG. 4) and a second position (as shown in FIG. 8 and FIG. 9).

The top cover 21 comprises a first indentation 211 and a first concavity 212. The first indentation 211 is disposed on the side surface of the top cover 21, and the first concavity 212 is disposed on another side surface, which is adjacent and vertical to the side surface. The bottom cover 22 comprises a second indentation 221 and a second concavity 222. The second indentation 221 and the second concavity 222 are respectively disposed on the near side surfaces of the side surface of the bottom cover 22, wherein the near side surfaces are adjacent and vertical to each other. The first indentation 211 corresponds to the second indentation 221. The first concavity 212 corresponds to the second concavity 222.

Referring to FIG. 2 again, the first concavity 212 comprises a first hook 212*a* and the second concavity 222 comprises a second hook 222*a*. The first hook 212*a* and the second hook 222*a* are disposed respectively at the right and left sides of the corresponding position. That is, as shown in FIG. 2, the first hook 212*a* is disposed at the right side of the first concavity 212, and the second hook 222*a* is disposed at the left side of the second concavity 222 corresponding to the first hook 212*a* toward the vertical surface. Additionally, the insulating portion 32 comprises a third hook 32*a*, a fourth hook 32*b* and a protrusion 33. The protrusion 33 is disposed between the third hook 32*a* and the fourth hook 32*b*.

Figure 3:
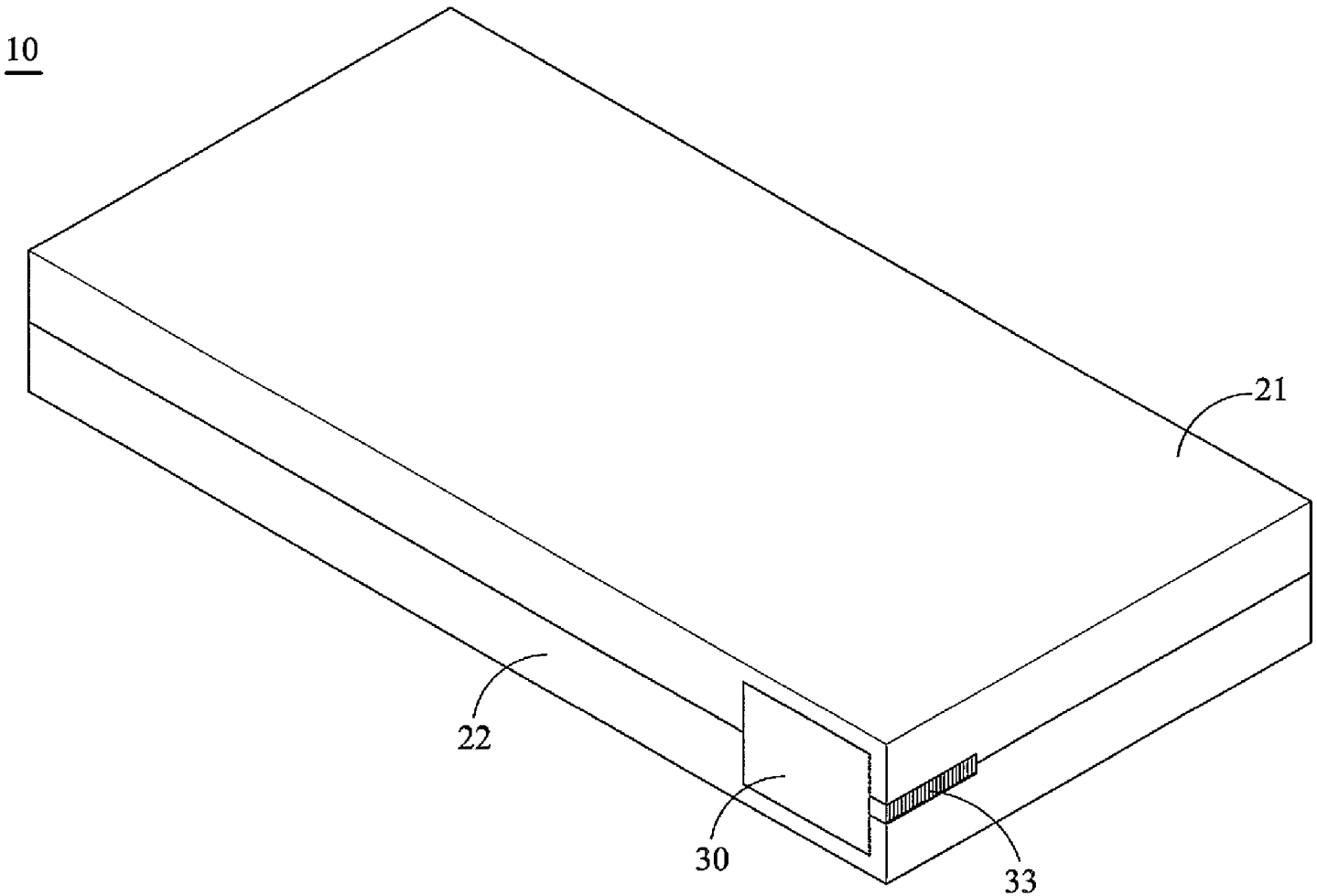
FIG. 3 is a schematic view of the USB plug of an embodiment of the portable electronic device in a first position.
Figure 4:
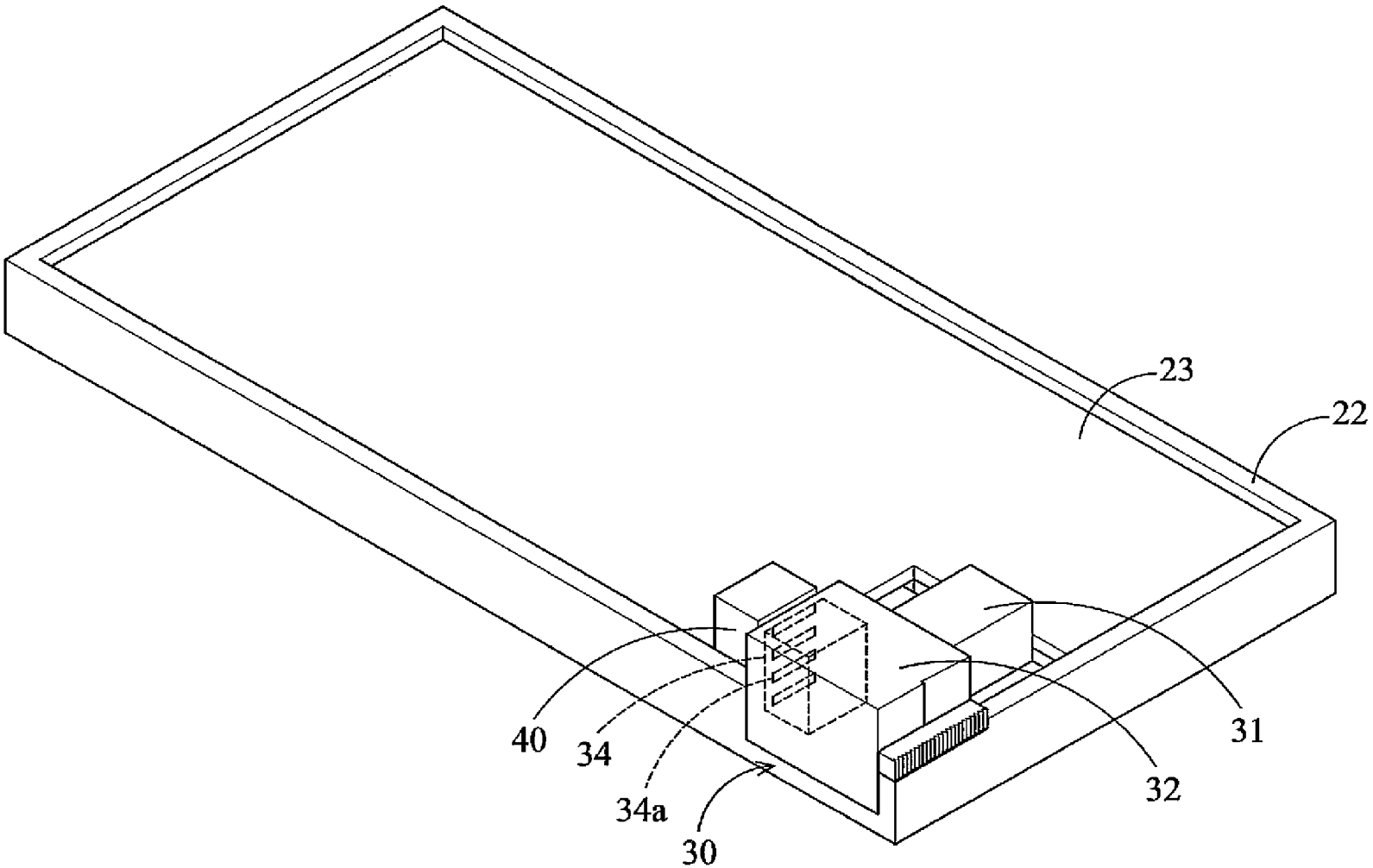
FIG. 4 is a schematic view of FIG. 3 when the top cover is removed.

FIG. 3 is a schematic view of an embodiment of the portable electronic device, wherein the USB plug is in a first position. Referring to FIG. 3, when the USB plug 30 is in the first position, the insulating portion 32 is engaged between the first indentation 211 and the second indentation 221. The protrusion 33 is engaged between the first concavity 212 and the second concavity 222. In FIG. 4, to clearly show the position of the USB plug 30, the top cover 21 is not depicted in the FIG. 4. FIG. 4 also shows the metallic plug 31 received in the body 20.

Figure 6:
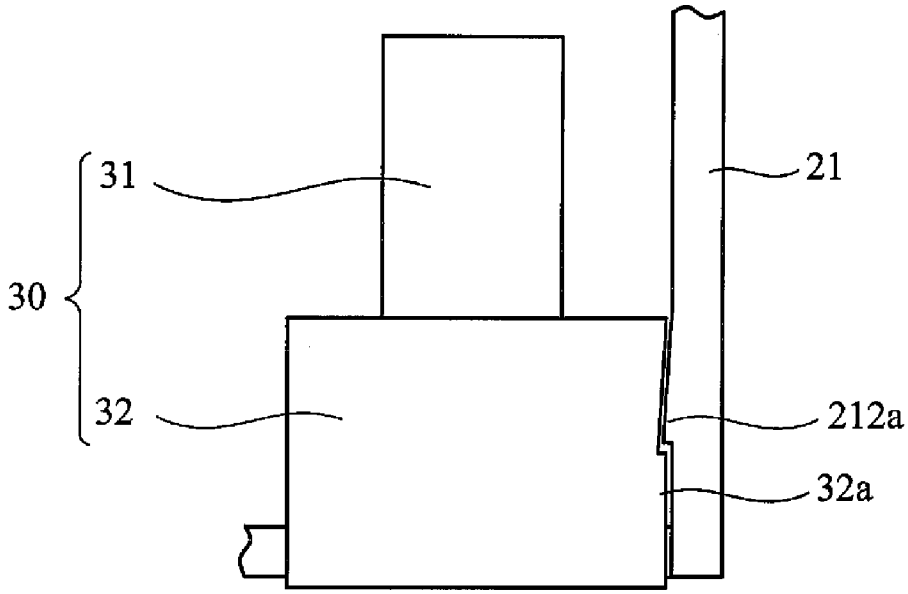
FIG. 6 is a schematic view of FIG. 3, wherein a USB plug is connected to the top cover.
Figure 7:
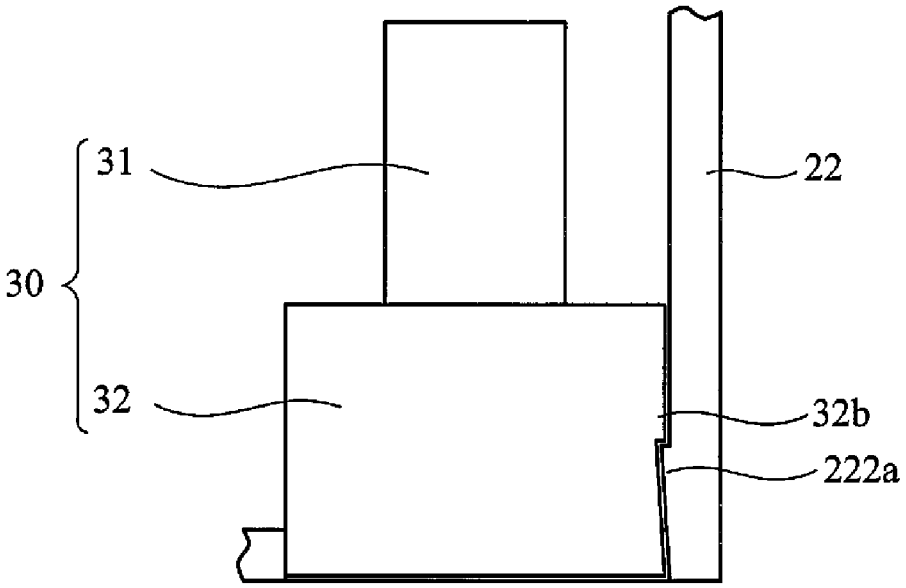
FIG. 7 is a schematic view of FIG. 3, wherein a USB plug is connected to the bottom cover.

FIG. 6 is a schematic view of FIG. 3, wherein a USB plug is connected to the top cover. FIG. 7 is a schematic view of FIG. 3, wherein a USB plug is connected to the bottom cover. In FIG. 6 and FIG. 7, the third hook 32*a* and the first hook 212*a* are engaged and on the same plane as the fourth hook 32*b* and the second hook 222*a*.

Figure 5A:
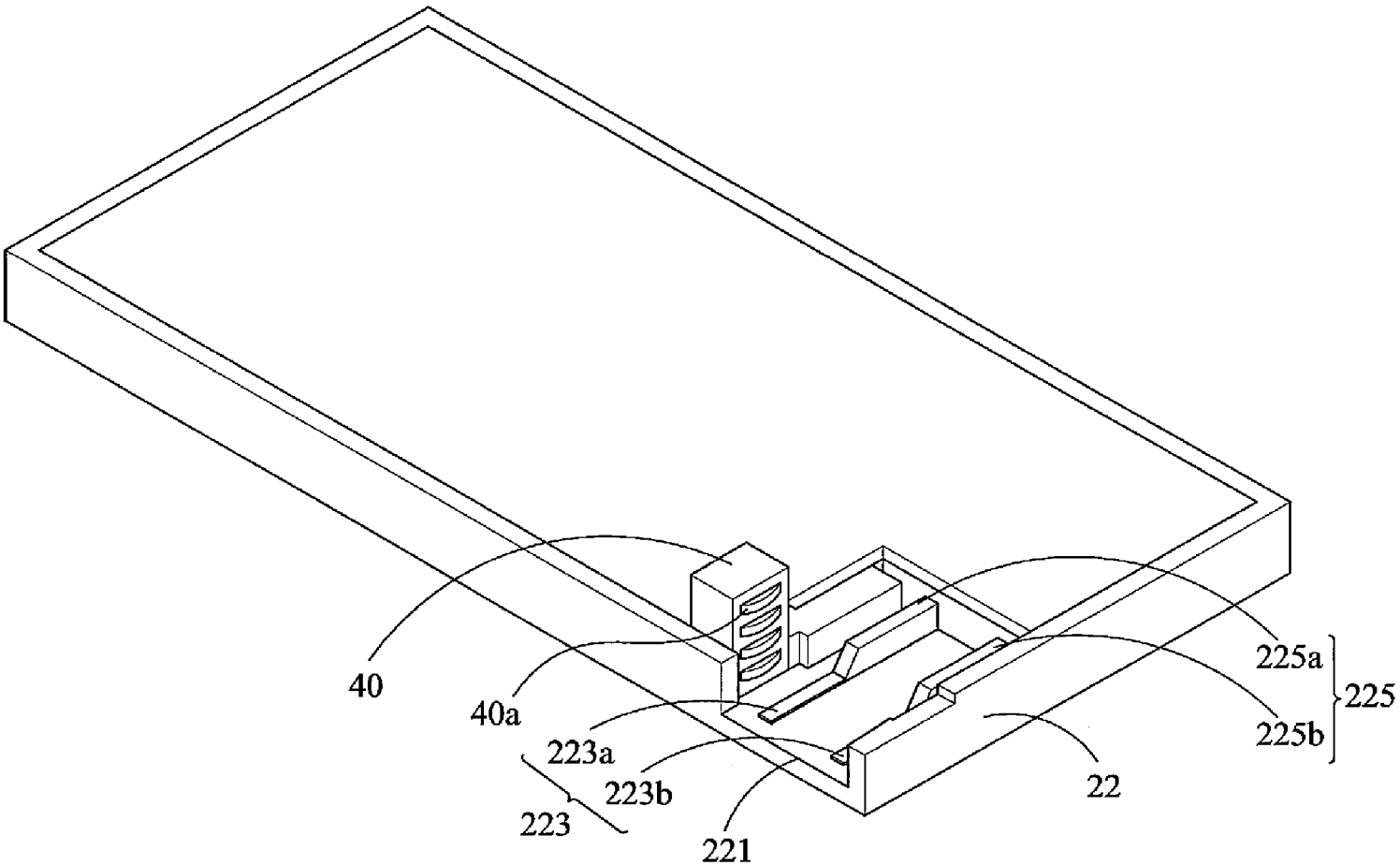
FIG. 5*a* is an interior schematic view of an embodiment of the portable electronic device.
Figure 5B:
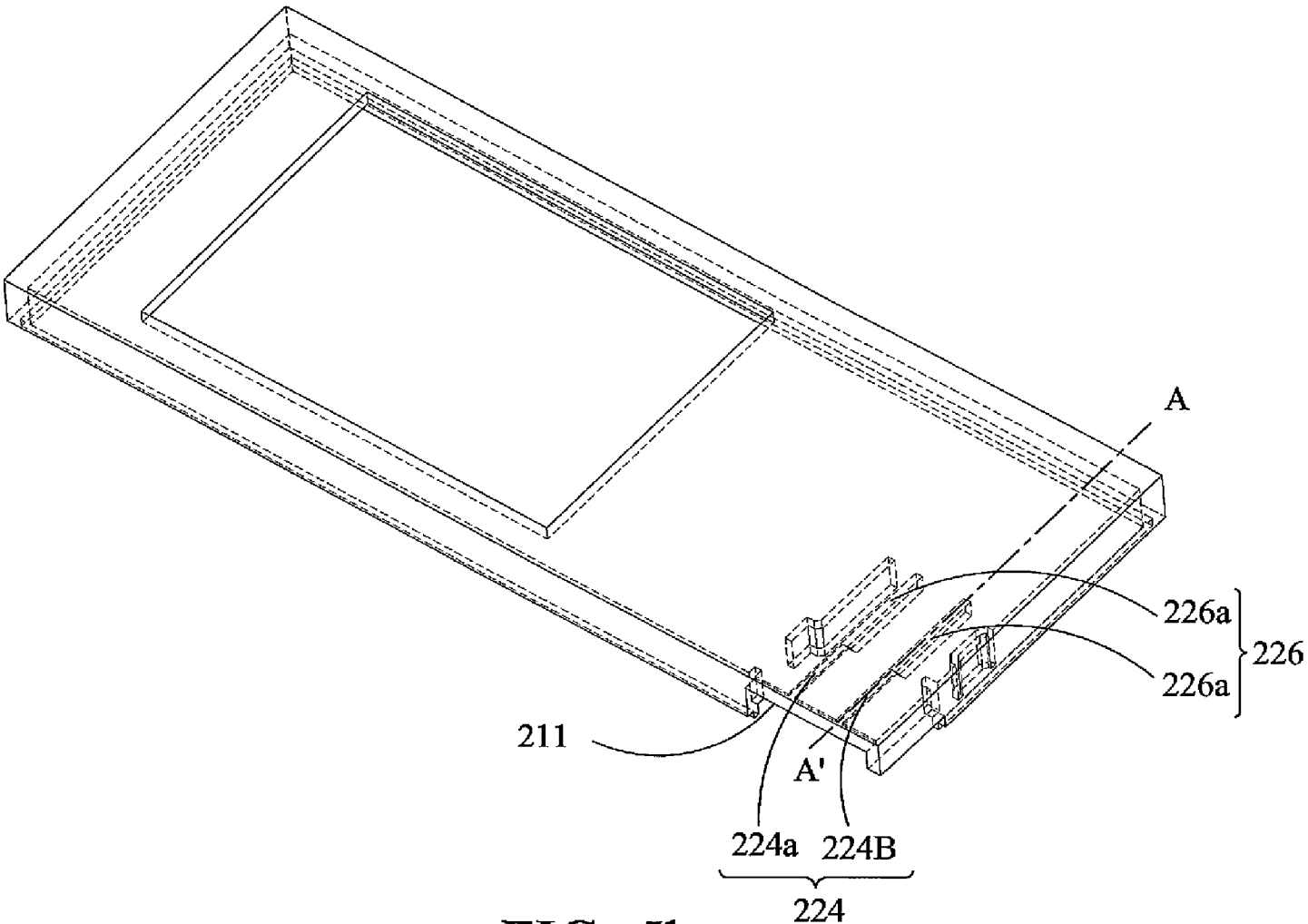
FIG. 5*b* is a schematic view of the top cover of an embodiment of the portable electronic device.
Figure 5C:
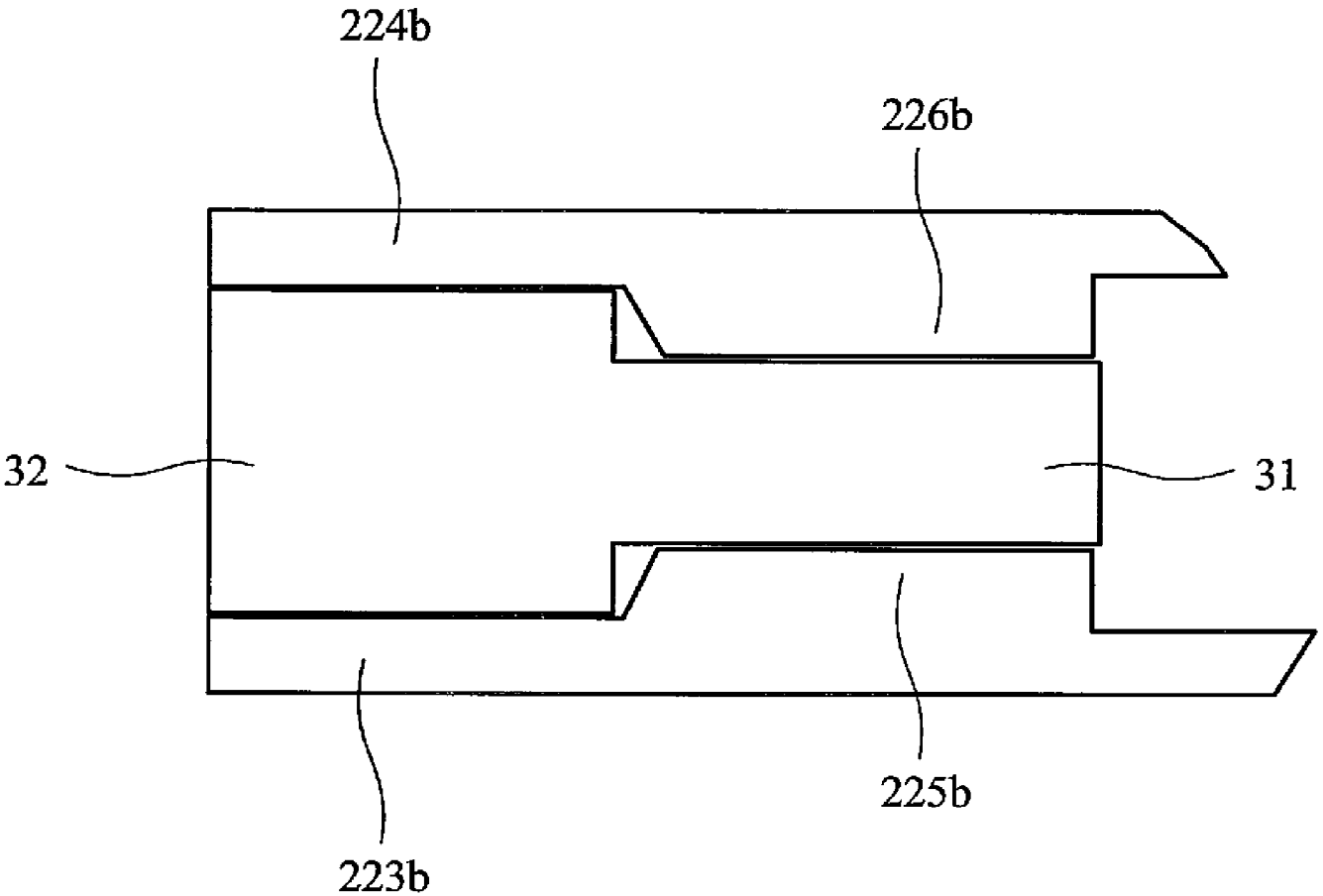
FIG. 5*c* is a schematic view of the engagement of the top and bottom covers of an embodiment of the portable electronic.

Additionally, as shown in FIG. 5*a*, the bottom cover 22 further comprises a bottom sliding portion 223 and a first limiting portion 225. The bottom sliding portion 223 comprises a first slider 223*a* and a second slider 223*b*. The first limiting portion 225 comprises a first limiting element 225*a* and a second limiting element 225*b*. The first slider 223*a* and the second slider 223*b* extend toward the interior from the edge of the second indentation 221. The first slider 223*a* and the second slider 223*b* are respectively connected to the first limiting element 225*a* and the second limiting element 225*b*. As shown in FIG. 5*b*, corresponding to the bottom cover 22, the top cover 21 comprises a top sliding portion 224 and the second limiting portion 226. The top sliding portion 224 comprises a third slider 224*a* and a fourth slider 224*b*. The second limiting portion 226 comprises a third limiting element 226*a* and a fourth limiting element 226*b*. The third slider 224*a* and the fourth slider 224*b* extend toward the interior from the edge of the second indentation 222. The third slider 224*a* and the fourth slider 224*b* are respectively connected to the first limiting element 226*a* and the second limiting element 226*b*. The distance between the first limiting portion 225 and the second limiting portion 226 is approximately less than the depth of the metallic plug 31, thus, an interference fit for limiting the metallic plug 31 is formed. Specifically, the first limiting element 225*a* and the third limiting element 226*a* are correspondingly disposed forming the interference fit, wherein FIG. 5*c* shows the sectional view along line A-A' when the top cover is engaged with the bottom cover.

The first slider 223*a*, the second slider 223*b*, the third slider 224*a*, and the fourth slider 224*b* help in limiting the position of the metallic plug 31. The first limiting element 225*a* and the third limiting element 226*a*, and the second limiting element 225*b* and the fourth limiting element 226*b* cooperate in limiting the position of the metallic plug 31, thus, separation of the USB plug 30 from the body 20 is prevented.

Note that the first limiting portion 225 and the second limiting portion 226 need not be correspondingly disposed, for example, the first limiting portion 225 and the second limiting portion 226 can be separated by a distance. Thus, the number of limiting elements is not limited to two as described, and can also be one or more depending on requirements. Additionally, the number of the limiting elements of the first limiting portion 225 and the second limiting portion 226 can be different.

Furthermore, note that the bottom sliding portion 223 and the top sliding portion 224 can be not connected to the first limiting portion 225 or the second limiting portion 226 and thus, the number of sliders of the top sliding portion 223 and the top sliding portion 224 can be different.

The interference fit of the second limiting portion 226 and the first limiting portion 225 limits the top and the bottom surface of the metallic plug 31 to achieve the limitation. Additionally, it can limit the right and the left sides of the metallic plug 31 to achieve the limitation. For example, the distance between the first limiting element 225*a* and the second limiting element 226*b* is approximately less than the width of the metallic plug, to form the interference fit.

Referring to FIG. 4 and FIGS. 5*a*-5*c*, the insulating portion 32 comprises a first connector 34, and the first connector 34 comprises a plurality of connector pins 34*a* (as shown in FIG. 4). The circuit board 23 further comprises a second connector 40, and the second connector 40 comprises connector pins 40*a* electrically connecting with connector pins 34*a* of the insulating portion 32. In the embodiment, when the USB plug 30 is in the second position, the connector pins 34*a* and the connector pins 40*a* are electrically connected. Additionally, the connector second 40 is an elastic element, for improving the ability of the USB plug 30 be engaged between the top cover 21 and the bottom cover 22.

As shown in FIG. 7, when the USB plug 30 is in the first position, the first hook 212*a* of the top cover 21 and the third hook 32*a* of the insulating portion 32 are engaged with each other. Referring to FIG. 7, the second hook 222*a* of the bottom cover 22 is engaged with the fourth hook 32*b* of the insulating portion 32.

Figure 10:
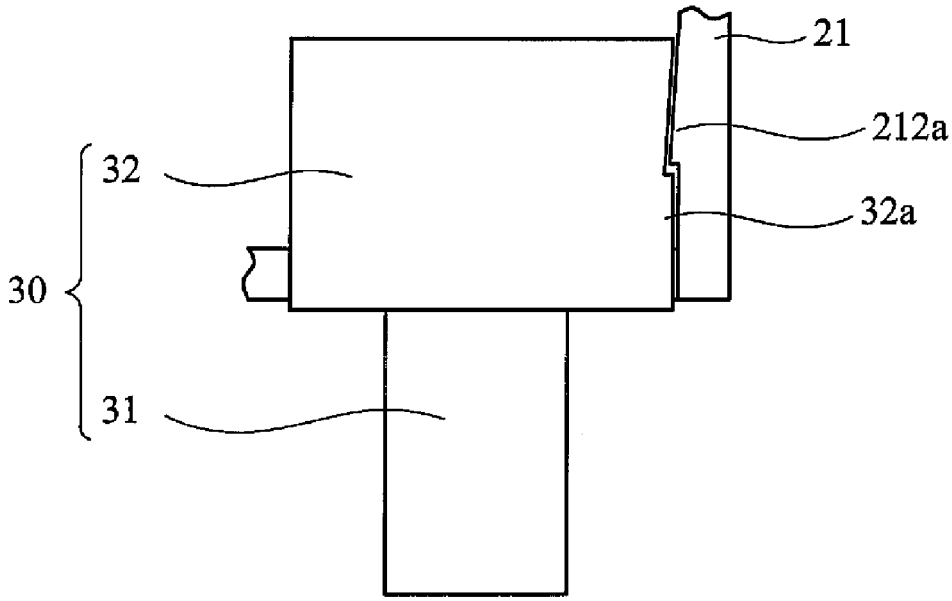
FIG. 10 is a schematic view of FIG. 8, wherein a USB plug is connected to the top cover.
Figure 11:
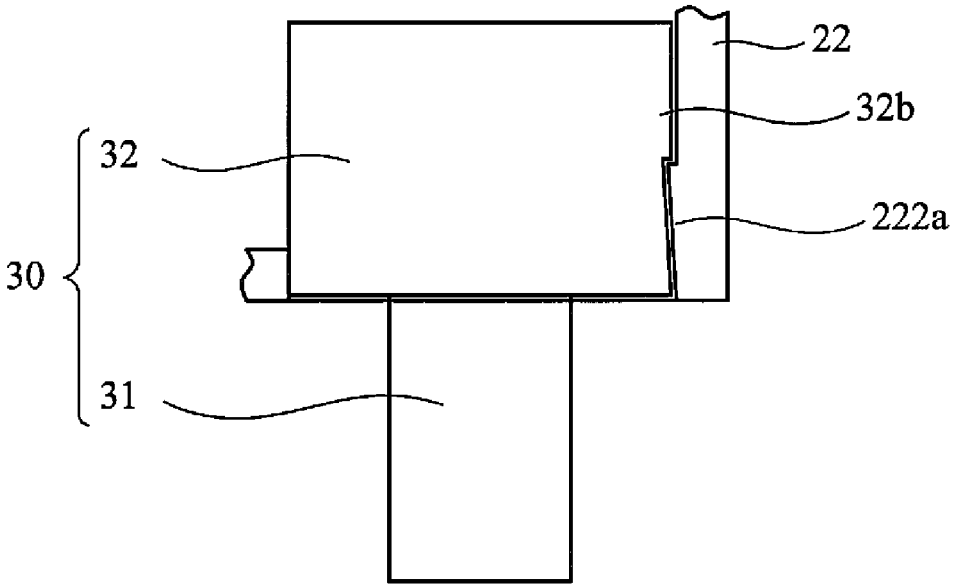
FIG. 11 is a schematic view of FIG. 8, wherein a USB plug is connected to the bottom cover.

FIG. 8 is an external schematic view of an embodiment of the portable electronic device, when the USB plug 30 is in a second position and the top cover 21 is omitted in FIG. 9 to clearly depict the USB plug 30 in the second position. The metallic plug 31 exposes outside the body 20 and the connector pins 40*a* of the second connector 40 are electrically connected to the connector pins 34*a* of the first connector 34, the elastic element of the second connector 40 is used in the insulating portion 32, so that the USB plug 30 can be tightly engaged between the top cover 21 and the bottom cover 22. Furthermore, referring to FIG. 10 and FIG. 11, when the USB plug 30 is in the second position, the first hook 212*a* of the top cover 21 is engaged with the fourth hook 32*b* of the insulating portion 32, the second hook 222*a* of the bottom cover 22 is engaged with the third hook 32*a* of the insulating portion 32, the metallic plug 31 faces outside the body 20.

When transmitting data, the protrusion 33 of the USB plug 30 is pushed to take off the USB plug 30, at the same time, the first hook 212*a* is separated from the third hook 32*a* and the second hook 222*a* is separated from the fourth hook 32*b*. Then, the USB plug 30 is revered to 180 degrees and is inserted between the first indentation 211 and the second indentation 212, so that the first hook 212*a* is engaged with the fourth hook 32*b* and the second hook 222*a* is engaged with the third hook 32*a*. At the same time, the connector pins

40*a* of the second connector 40 are electrically connected to the connector pins 34*a* of the insulating portion 32 and the metallic plug 31 is exposed outside the body 20, enabling direct connection and data communication with another portable electronic device.

When receiving the USB plug 30 in the body 20, the protrusion 33 is pushed and the USB plug 30 is accommodated so that the insulating portion 32 is separated from the body 20. The procedure is reversed when the USB plug 30 makes the metallic plug 31 faces the body 20. In addition, the metallic plug 31 is pushed along the bottom sliding portion 223 of the bottom cover 22 and the top sliding portion 224 of the top cover 22, and is limited between the first limiting portion 225 and the second limiting portion 226. At the same time, the first hook 212*a* of the top cover 21 is engaged with the third hook 32*a* of the insulating portion 32, and the second hook 222*a* of the bottom cover 22 is engaged with the fourth hook 32*b* of the insulating portion 32, to fix the USB plug 30 in the body 20.

The portable electronic device 10 with detachable USB plug can be easily received in the portable electronic device 10. When using the USB plug 30, the USB plug 30 can be reversed to connect to the portable electronic device 10 and another device for transmitting data without an additional data communication cable.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A portable electronic device, comprising:

a body comprising a top cover and a bottom cover, wherein the top cover is engaged with the bottom cover;

a circuit board disposed in the body; and a data communication plug comprising a metallic plug and an insulating portion connecting with the metallic plug, wherein the data communication plug is detachably disposed between the top cover and the bottom cover, and is positionable in a first position and a second position, wherein the metallic plug and the insulating portion respectively abut the top cover and the bottom cover when the data communication plug is in the first position, wherein the metallic plug is disposed outside the body and the insulating portion is disposed inside the body when the data communication plug is in the second position.

2. The portable electronic device as claimed in claim 1, wherein the data communication plug is an universal serial bus plug.

3. The portable electronic device as claimed in claim 1, wherein the insulating portion further comprises a first connector and the circuit board further comprises a second connector, when the data communication plug is in the second position, the first connector is connected to the second connector.

4. The portable electronic device as claimed in claim 3, wherein the second connector is an elastic structure.

5. The portable electronic device as claimed in claim 1, wherein the top cover comprises a first indentation and a first concavity, wherein the first indentation is vertical and adjacent to the first concavity.

6. The portable electronic device as claimed in claim 5, wherein the bottom cover comprises a second indentation and a second concavity, wherein the second indentation is vertical and adjacent to the second concavity, the first concavity corresponds to the second concavity.

7. The portable electronic device as claimed in claim 6, wherein the first concavity comprises a first hook and the second concavity comprises a second hook, the first hook is opposite the corresponding position of the second hook.

8. The portable electronic device as claimed in claim 7, wherein the insulating portion comprises:

a third hook;

a fourth hook disposed opposite the corresponding position of the third hook; and a protrusion disposed between the third hook and the fourth hook, wherein when the data communication plug is in the first position, the first hook is engaged with the third hook and the second hook is engaged with the fourth hook, the protrusion is engaged with the first indentation and the second indentation, and the metallic plug is received in the body.

9. The portable electronic device as claimed in claim 8, wherein the top cover further comprises a top sliding portion and the bottom cover further comprises a bottom sliding portion, the top sliding portion is disposed in the first indentation and the bottom sliding portion is disposed in the second indentation.

10. The portable electronic device as claimed in claim 9, wherein the top sliding portion and the bottom sliding portion comprise a plurality of correspondingly disposed sliders.

11. The portable electronic device as claimed in claim 9, wherein the top cover further comprises a first limiting portion and the bottom cover comprises a second limiting portion, the first limiting portion corresponds to the second limiting portion.

12. The portable electronic device as claimed in claim 11, wherein the first limiting portion and the second limiting portion are respectively connected to the top sliding portion and the bottom sliding portion.

13. The portable electronic device as claimed in claim 11, wherein the first limiting portion and the second limiting portion further comprises a plurality of limiting elements, each limiting element is disposed corresponding to each other.

14. A portable electronic device, comprising:

a body;

a circuit board disposed in the body; and a data communication plug comprising a metallic plug and an insulating portion connecting with the metallic plug, wherein the data communication plug is detachably disposed in the body in a manner such that the data communication plug is positioned between a first position when the plug is disposed inside the body and a second position when the metallic plug is disposed inside the body;

wherein the insulating portion comprises a first connector and the circuit board comprises a second connector, the first connector is connected to the second connector when the data communication plug is in the second position, and the first connector is not connected to the second connector when the data communication plug is in the first position.

15. A portable electronic device, comprising:

a body comprising a first hook and a second hook;

a circuit board disposed in the body; and a data communication plug comprising a metallic plug and an insulating portion connecting with the metallic plug, wherein the data communication plug is detachably disposed in the body in a manner such that the data communication plug is positioned between a first position when the metallic plug disposed inside the body and a second position when the metallic plug is disposed outside the body;

wherein the insulating portion comprises:

a third hook;

a fourth hook disposed opposite the corresponding position of the third hook; and wherein the first hook is engaged with the third hook and the second hook is engaged with the fourth hook when the data communication plug is in the first position, and the first hook is engaged with the fourth hook and the second hook is engaged with the third hook when the data communication plug is in the second position.

* * * * *